United States Patent [19]

Moss

[11] 4,266,355

[45] May 12, 1981

[54] SHELF DISPLAY

[76] Inventor: Jerome A. Moss, 333 West End Ave., New York, N.Y. 10023

[21] Appl. No.: 973,750

[22] Filed: Dec. 26, 1978

[51] Int. Cl.[3] ..... G09F 1/00

[52] U.S. Cl. ..... 40/124.1; 40/539

[58] Field of Search ..... 40/124.1, 539, 618, 40/610, 492; 46/34; 248/460, 463

[56] References Cited

U.S. PATENT DOCUMENTS

| | | | |
|---|---|---|---|
| 890,135 | 6/1908 | Gilliland | 40/124.1 |
| 1,379,739 | 5/1921 | Bennett | 40/124.1 |
| 2,404,089 | 7/1946 | Pollock | 40/539 |
| 2,601,374 | 6/1952 | Dittzler et al. | 40/539 |
| 2,869,504 | 1/1959 | Andrews et al. | 40/618 |
| 3,035,363 | 5/1962 | Luchsinger | 40/124.1 |
| 3,471,958 | 10/1969 | Westin | 40/124.1 X |
| 4,103,444 | 8/1978 | Jones et al. | 40/124.1 |

FOREIGN PATENT DOCUMENTS

| | | | |
|---|---|---|---|
| 758823 | 10/1956 | United Kingdom | 40/124.1 |

*Primary Examiner*—Gene Mancene
*Assistant Examiner*—Wenceslao J. Contreras
*Attorney, Agent, or Firm*—Marvin Feldman; Stephen E. Feldman

[57] ABSTRACT

A display is disclosed which is disposed on a shelf wherein the merchandise rests on the display and when the merchandise is removed from the display, the display springs upward and forward so as to provide an advertising message display surface at the forward part of the shelf. The message display surface serves both to remind the store personnel of the need to refill the shelf with the proper identified product while at the same time providing advertising surface relating to the product for the consumer. This display secures the shelf space for the identified product.

12 Claims, 6 Drawing Figures

SHELF DISPLAY

FIELD OF THE INVENTION

This invention relates to a dsiplay. Specifically this invention relates to a display for a shelf wherein products are removed therefrom.

BACKGROUND AND DISCUSSION OF PRIOR ART

It was known in the vending machine field to provide spring actuated mechanically-controlled signs to indicate that the machine was empty and required refill of a particular product. Such mechanical devices for vending machines are disclosed in Weitlock, U.S. Pat. No. 852,088 and Fogelsonger, U.S. Pat. No. 1,556,777.

While such prior art devices were suitable within the context of a mechanical vending machine they were not suitable for application where space and economics mitigated against such devices.

It was thus desired in the prior art to provide refill notice which would be suitable for small space utilization but at low cost, and particularly so in large volume applications.

It was also desirable in the merchandising field to maximize the advertising space available in shelving, particularly shelving as found in supermarkets, mass merchandisers and retail stores.

Now there is provided by the present invention a display which is specifically useful in a shelf environment, and wherein the removal of the product actuates the display.

It is thus a principal object of the present invention to provide a shelf display which is actuated by the removal of the merchandise on the shelf.

It is another object of this invention to provide a shelf display as afôresaid wherein the unactivated condition of the display does not interfere with the normal shelf stocking of merchandise.

It is still a further object of this invention to provide a shelf display wherein when actuated, the message display surface is disposed at the forward edge of the shelf.

It is still a further object of the present invention to provide a display which resides in the back of the shelf, but when actuated provides a message at the forward end of the shelf, and is adaptable to do so over a wide range of shelf sizes.

It is a further object of the present invention to provide a display shelf as aforesaid which is readily constructed of relatively inexpensive materials and yet is practical and functional in its intended use.

The aforesaid as well as other objects and advantages as will become apparent from a reading of the following description, the adjoined claims, and the drawings in which:

DESCRIPTION OF THE PREFERRED EMBODIMENTS

Figure 1:
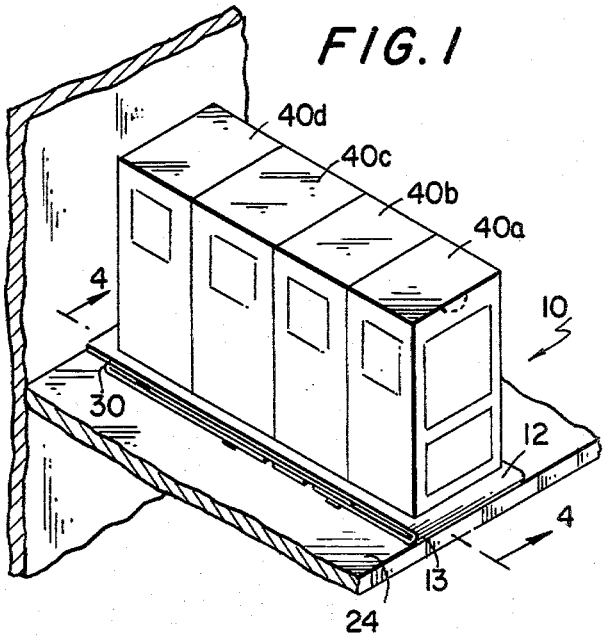
FIG. 1 is a perspective view of the display in the collapsed condition with the merchandise thereon.
Figure 2:
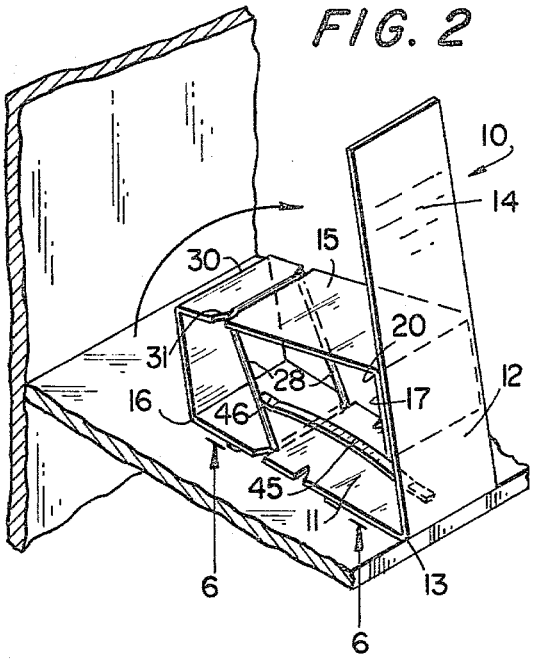
FIG. 2 is another perspective view of the display after removal of the merchandise as display moves open to the actuated position.

Referring to FIGS. 1–4 there is shown the display of the present invention generally referred to as numeral 10. Display 10 is formed from a single cardboard strip 10*a* which is folded in a manner to be more fully explained hereinafter and glued as at 11. Display 10 thusly comprises a base member as portion 11 and a display member as portion 12 connected by and at fold 13, so that member 12 is pivotally disposed in relation to base 11. Display member 12 is formed with a message display surface 14 for purposes hereinafter appearing.

Figure 6:
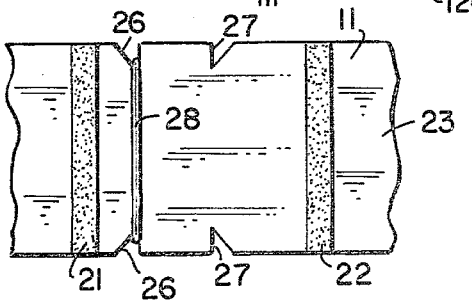
FIG. 6 is a fragmentary bottom view of the display base.

Display member 12 is in turn connected to a connecting member as portion 15 by and at fold 20, and the end portion 17 of portion 15 is glued to the back 18 of portion 12 as at 19. Base 11 is provided with double faced adhesive strips 21 and 22 on the bottom side 23 (FIG. 6) so that the base is securely bonded to shelf 24. With base 11 securely bonded to shelf 24, members 12 and 15 are pivotally movable in relation to the base.

Base 11 is formed with two pairs of vee-cuts or vee-grooves 26 and 27 respectively, and a elastic rubber band 28 fits between side 23 of base 11 and shelf 24 and into grooves 26 (grooves 27 being an alterante placement). Rubber band 28 in turn fits into vee-grooves 31 of member 15. Member 15 is formed with score 30.

Figure 5:
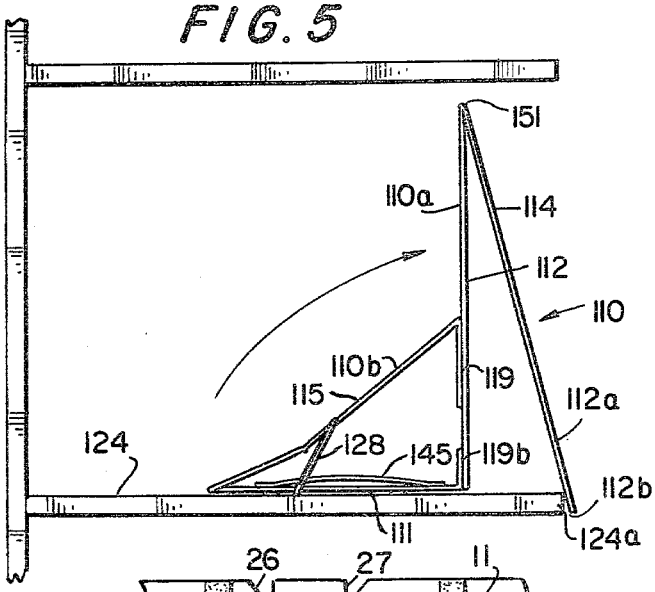
FIG. 5 is a side elevational view of an alternate embodiment.
Figure 4:
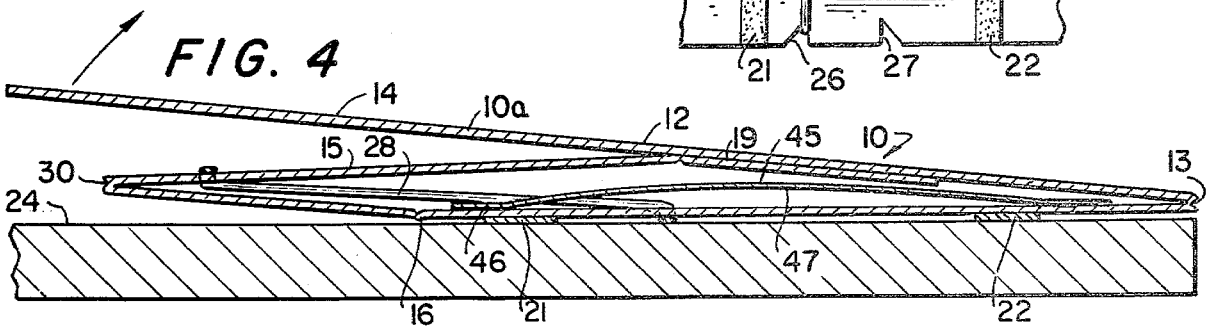
FIG. 4 is an enlarged sectional view taken along line 4—4, but shows the display during initial actuation.

In this manner of construction, display member 12 may be folded down on member 15 which folds at score 30 but unfolds at 16, so that members 12, 15 and 11 lie flat, as best shown in FIGS. 1 and 4. With the members lying flat, rubber band 28 is in a stretched taut condition exerting a force on member 15 causing unfolding of score 30 and fold 13, with concommmitant folding at 16, as best shown in FIG. 5.

Referring specifically to FIG. 1 there is shown the display 10 in the fully folded position with merchandise 40*a*, 40*b*, 40*c*, and 40*d* resting on display member 12; the weight of the merchandise holding the display in the folded or closed position. As merchandise is customarily removed from the shelf from 40*a* to 40*d* in seriatim, the display remains folded unless and until the last merchandise then is removed. With the removal of the last merchandise then the display is rapidly actuated to the unfolded position as represented in stages of FIG. 4, FIG. 2 and then to the upright position of FIG. 3 (or FIG. 5).

Figure 3:
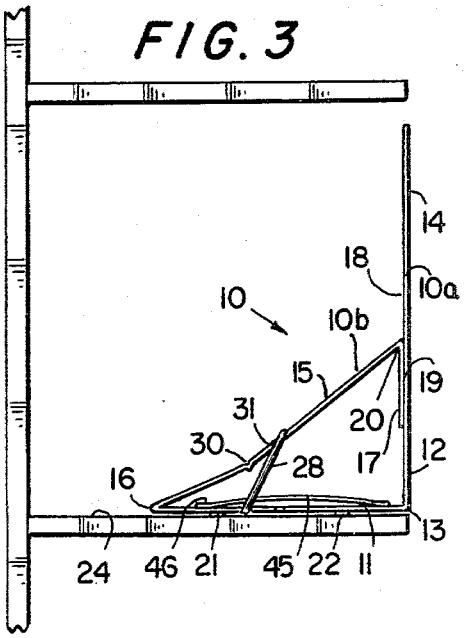
FIG. 3 is a side elevational view of the display in the fully actuated condition.

It has been found that when rubber band 28 is retained in the stretched condition of FIG. 1, for extended periods, the elasticity of the band is diminished to a point where it is insufficient to initiate actuation of the display upon the removal of the merchandise. To eliminate this, a second cooperative elastic means, namely fine steel spring 45 is secured to base 11 as by an adhesive at 46. The spring 45 is formed with a bowed position 47 which exerts an upward force against display member 12. Thus the spring 45 provides and assures the provision of an initial upward force sufficient such that with this force, the rubber band 28, even if of diminished elasticity, will nevertheless complete the actuation to the upright position as shown in FIG. 3.

It has thus been found that the rubber band and spring cooperate to assure full actuation over an extended period of use.

Referring now to FIG. 5, there is shown an alternate embodiment 110 which has generally similar construction features to embodiment 10 except as is further pointed out. Embodiment 110 is formed of two cardboard strips 110*a* and 110*b* which are adhesively secured to each other at 119 and 119*a*. Strip 110*b* provides base member 111, and connecting member 115, folded therewith, and associated elastic band 128 and spring 145, in a manner similar to embodiment 10 heretofore discussed. Thus the unfolding actuation is similar except that embodiment 110 is of a two-piece construction. Another difference is that member 112 is of extended length and folded at 151 so the end portion 112*a* is disposed forwardly of portion 112. It is portion 112*a* that bears the message display surface 114. Portion 112*a* is formed with edge 112*b* which extends to or overlaps the edge 124*a* of shelf 124. Of course in the folded condition, the merchandise rests on surface 114 and members 112 and 112*a* are in contact.

In this manner of construction, the message display is brought forward to or adjacent the edge of the shelf for better viewing. This is particularly important where there is deep recessed shelving. It is also to be understood that display 10 and 110, particularly 110, may be disposed more rearwardly of the shelf. In such rearward disposition fold 151 would be at the rearward shelf corner and member 112*a* would slide forward to the shelf edge at a more obtuse angle than 151 in FIG. 5. Further a plastic sheet can be disposed between extended 112*a* portion and the surface of shelf 24 so that the merchandise is stacked evenly.

The elastic means useful in the present invention may be any element with resilience so as to project the display member from a flat disposition to an upright disposition. While a rubber band may alone by useful for this purpose, it was found that after a considerable period, the rubber band in the partically stretched condition, as where the members lie flat, the elasticity of the rubber diminished substantially so as not to have sufficient force to propel the display member to the upright condition. To overcome this, a second elastic means namely a fine steel spring member was incorporated in combination with the rubber band, as shown in the FIGS. In this manner of construction the steel spring member would provide an initial boost to the display member at which time the rubber band, although of diminished elasticity; would still be sufficient to complete the uprighting of the display member.

It is to be understood that the display sufface of the display member may be employed for numerous information purposes and preferrably to remind the stock clerk to replenish the shelf with a particular item designated for that space. This message display surface may also be employed to advertise the merchandise to the consumer, so that the consumer might request the item even if not for that moment available on the shelf but otherwise available in the storeroom.

One possible desired modification is that members 12 or 112*a* may readily and economically be shaped into the configuration of the merchandise such as a bottle-shape for better product recognition.

While the aforesaid describes a display composed of adhesively bonded cardboard members, it is also within the contemplation of this invention to construct such members of plastic sheeting, such as the thermoplastics (e.g. polyolefins, polyesters, polyvinyls, and co-polymers thereof). Where thermoplastics are employed it is also with the contemplation of the invention to plastic bond (e.g. epoxy) or thermoweld the plastic members. It is also within the contemplation of this invention to mold the display from thermoplastic as an integral unit.

The foregoing description shows the invention by way of examples only and further modification can be made without departing from the spirit of the invention.

What is claimed is:

1. A display comprising a base member and a display member movably connected to said base member, and said display member comprising a message display surface, and a connecting member, one end thereof being movably connected to said base member and the other end thereof being movably connected to said display member and elastic means disposed between said base member and display member and operatively associated with said members to move said display member from a folded down position upwardly from said base member, said elastic means further comprising spring means disposed between said base member and said display means, whereby said spring means initiates the movement of said display member and said elastic means completes said movement, said display being adapted to be disposed on a shelf with merchandise on said display member, whereby removal of the merchandise actuates the elastic means to cause the display member to move upwardly from the base member so that the message display surface is viewable from the front of the shelf.

2. The display of claim 1, further comprising bonding means attached to said base member to bond said member to said shelf.

3. The display of claim 1, said elastic means comprising an elastic band surrounding said base member and said connecting member.

4. The display of claim 1, said connecting member being formed with a score so as to be folded when the merchandise is thereon and unfolded when the display actuated.

5. The display of claim 1, said base member and connecting members being formed with means to receive the elastic means.

6. The display of claim 1, wherein said members are formed of cardboard.

7. The display of claim 1, wherein said members are formed of plastic.

8. The display of claim 1, said display member comprising a first position connected to said base member and a second portion pivotally hinged with said first portion, said message display surface being disposed on said second portion, whereby the second portion pivots forward of said first portion in the actuated condition.

9. A display comprising:

a. a base member, b. a display member, c. a connecting member, and d. elastic means operably associated with said members, said members being interconnected so as to fold flat with weight applied on said display member and said elastic means further comprising spring means disposed between said base member and said display member, whereby said spring means initiates the movement of said display member and said elastic means completes said movement, and with the release of said weight said elastic means unfolds said members so that said display is moved from the folded flat position upwardly from the base member.

10. The display of claim 9, said members being pivotally hinged to each other, and said connecting member comprising a score so to be folded thereat.

11. The display of claim 9, said members being formed of a plastic.

12. The display of claim 9, said elastic means comprising a spring means.

* * * * *